United States Patent [19]

Evertz et al.

[11] 3,990,291

[45] Nov. 9, 1976

[54] BENDING MACHINE FOR BENDING SHEET AND STRIP

[75] Inventors: Egon Evertz; Rolf Seybold, both of Solingen, Germany

[73] Assignee: Egor Evertz, Solingen, Germany

[22] Filed: Apr. 8, 1975

[21] Appl. No.: 566,610

[30] Foreign Application Priority Data

Apr. 18, 1974 Germany ..... 2418668

[52] U.S. Cl. ..... 72/382; 72/389; 72/396

[51] Int. Cl.[2] ..... B21D 5/02

[58] Field of Search ..... 72/380, 382, 396, 381, 72/466, 465, 389

[56] References Cited

UNITED STATES PATENTS

| | | | |
|---|---|---|---|
| 361,487 | 4/1887 | Brownson | 72/382 |
| 1,948,474 | 2/1934 | Meyer | 72/396 |
| 2,650,637 | 9/1953 | Paxson | 72/389 |
| 2,882,952 | 4/1959 | Johnson | 72/396 |

*Primary Examiner*—C.W. Lanham
*Assistant Examiner*—James R. Duzan

[57] ABSTRACT

A bending apparatus for bending individual sheet and strip blanks and having a bending punch curved to a radius less than the desired bending radius. Tip-supports are arranged at either side of the punch and are pivotable in the bending plane. Each support has a supporting pad for holding the blank and the pivotal articulations of the supports are arranged beneath the pads and spaced horizontally from the edges of the pads facing the punch.

2 Claims, 4 Drawing Figures

BENDING MACHINE FOR BENDING SHEET AND STRIP

The present invention relates to a bending apparatus for bending sheet and strip of the kind wherein one blank sheet or strip at a time is individually treated by means of a bending punch provided for the purpose.

For mass production of objects in large numbers sheet stock is usually formed with the aid of press forming dies of suitable profile, the stock being subjected to bending deformation to conform to said profile. In many cases, however, the total number of blank sheets to be treated is not sufficient to justify the outlay of a bending press. Yet, even for the manufacture of single, or small numbers of parts, the requirements regarding bending angle and bending radius in the bending deformation to be produced are frequently so stringent that their realisation demands the provision of special bending tools.

Bearing this in mind, the invention aims to provide a bending apparatus which is adapted for virtually universal use over a considerable range of bending angles and radii. It is the aim of this invention that a bending apparatus of this kind should be capable of producing the desired bending deformation in the work without significant outlay of tools and also for application of individual, as distinct from mass-production methods.

According to the invention a bending apparatus comprises a bending punch which is curved to a radius less than the proposed bending radius, and a pair of tip-supports disposed resectively at either side of the punch and pivotable in the bending plane, each support having supporting pads for holding the blank, the pivotal articulations of the supports being arranged beneath the said pads respectively and horizontally spaced away from the edges of said pads facing the bending punch.

With a bending apparatus of this comparatively simple design it is possible, by an appropriate downward stroke of the bending punch, to achieve bending deformation up to bending angles of 180°. The bending radius, which in each bending deformation is largely independent of the bending angle, is limited merely by the curvature of the bending punch which, for this reason, is less than a predetermined, or proposed bending radius, the latter in practice being expected to be the minimum final radius. Thanks to the special disposition of the articulations of the tip supports, the blank which is placed onto their pads can always align itself with its portions engaging with the bending punch to extend tangentially relative to the bending curve. This means that a small bending radius may be obtained with a large bending angle by merely operating the bending punch once. If a greater bending radius is required, the bending operation is performed in several successive steps or stages, the punch being lowered correspondingly less for each individual bending stage and successive portions of the sheet or strip blank being progressively presented beneath the punch for bending. In this arrangement the nature of engagement between the blank and the work-supporting pads of the tip supports is such that the points of mutual contact are not slidingly displaced or shifted during bending because, owing to the position of the articulations of the tip supports, the edges of the pads which face the punch are mutually approached while they descend in the direction towards the bending punch. In this way, substantially all displacement or slipping of the blanks relative to the pads is prevented, which not only eliminates the need for otherwise necessary work-gripping means but also ensures a very careful treatment of the surface of the blank.

Conveniently, the pivotal articulations of the tip-supports are adjustable and adapted to be fixed with regard to their horizontal distance relative to the bending punch so that the full advantages of the bending apparatus may be utilised even in the event of a bending deformation considerably outside the normal range of the apparatus.

It is frequently required that the bending angle and/or bending radius should differ over a wider range. This will lead to so-called conical bending. This can be achieved in the simplest way with the aid of the bending apparatus of the invention by virtue of the fact that the press tool is adjustable in an inclined or oblique position and, furthermore, that the tip-supports are obliquely adjustable in a horizontal plane. The tip-supports are set at an oblique angle in such a way that their pivot axes are aligned with a point corresponding approximately with the apex of the cone according to which the bending deformation is to occur.

The invention will now be described, by way of example, with reference to the accompanying drawings in which.

Figure 1:
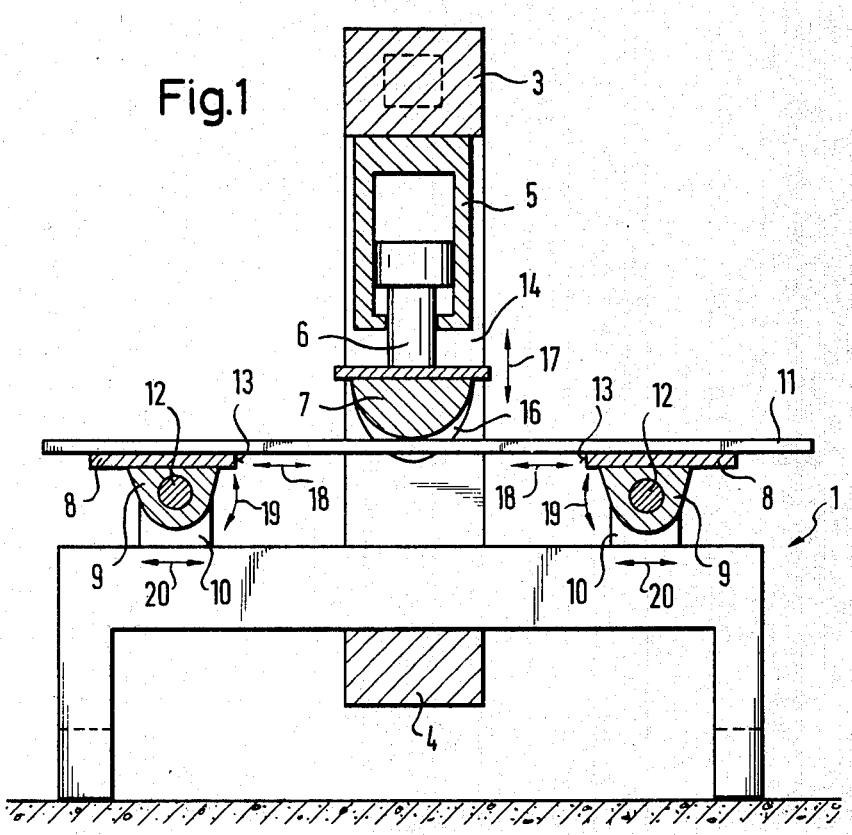
FIG. 1 is a frontal part-sectional view of the bending apparatus of the invention.
Figure 2:
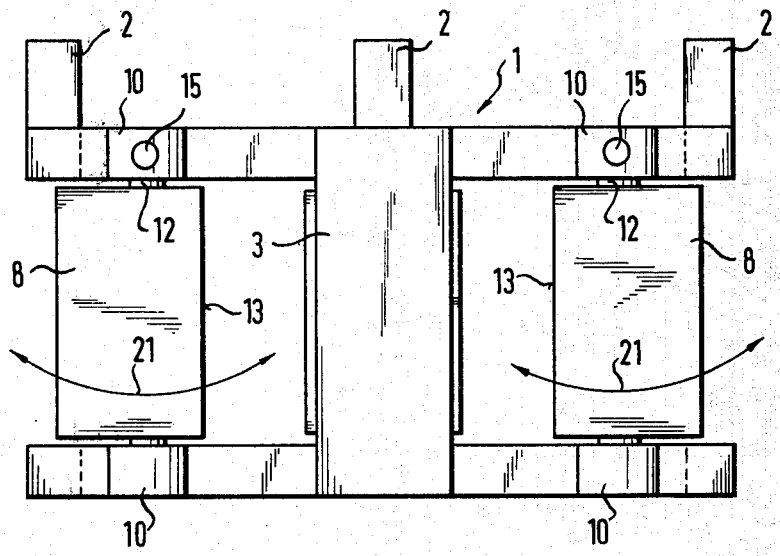
FIG. 2 is a plan view from above corresponding to FIG. 1.

Referring to the drawings, FIG. 1 shows the bending apparatus of the invention comprising a frame 1, stability of which has been improved by the legs 2 as seen from FIG. 2. A horizontal beam, or like portion, of the frame 1 carries supporting bearings 10 which are adjustable in the direction of the double-pointed arrows 20 and adapted to be fixed, in their positions. These bearings 10 together with the lower part of the see-saw, or tip-supports 9 form pivotal articulations or joints 12, by means of which the tip-supports, together with the work-holding pads 8 fitted thereon, may be pivoted in vertical planes as indicated by the double-pointed arrows 19. The mutually facing edges 13 of the work-supporting pads 8 will be relatively approached when the tip-supports are pivoted downwardly towards the middle, the degree of mutual approach being determined by their spacing relative to the axes of the articulations 12. If a blank 11 is placed on the pads 8 and then subjected to bending deformation in the middle of the blank, slipping or sliding displacement of the blank 11 on the pad 8 is virtually precluded by the pivoting of the tip-supports and mutual approach of their frontal edges.

The horizontal supporting element of the frame 1 further comprises a lower transverse or cross head 4, with vertical strands 14, and an upper cross head 3. A hydraulic ram (cylinder) 5 is mounted in the cross head 3, the piston rod 6 extending downwardly and carrying the operative press tool 7 of the bending punch. Consequently, as has been described, it is possible, selectively to execute a bending deformation at small radius of curvature in a single operation or to obtain a bending deformation about the same bending angle at a larger radius of curvature in the course of several successively applied operational steps or stages.

In the latter case, the blank to be treated is displaced slidingly in one of the two directions of the arrow 18.

If a bending operation is carried out in the course of several steps or stages, the operative movement of the press punch in the direction of the double-pointed arrows 17 is performed in several successive regions of the blank, starting afresh with a zero position for each individual region.

As may be observed from the plan view of FIG. 2, the tip-supports with their pads 8 as well as the press tool 7 of the bending punch are sufficiently wide to allow even large sheet metal blanks to be treated. When a conical bending operation is required, the tip supports are pivoted about their articulations 15 in the horizontal plane as shown by double-pointed arrows 21 while the press tool 7 is set at an oblique angle in a vertical plane so that its operative face 16 may bend the blank 11 in accordance with the proposed angle of conicity.

Figure 3:
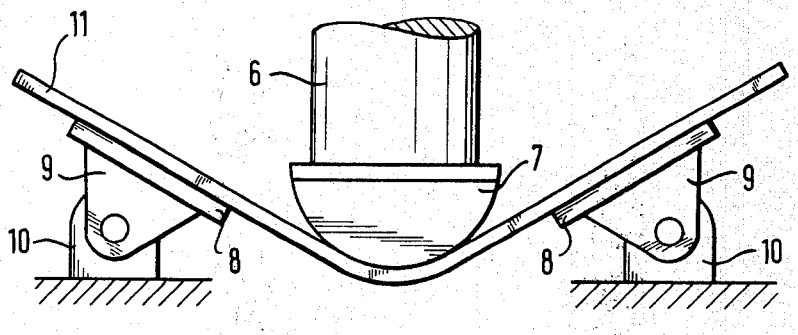
FIG. 3 shows a sheet or strip blank during bending.
Figure 4:
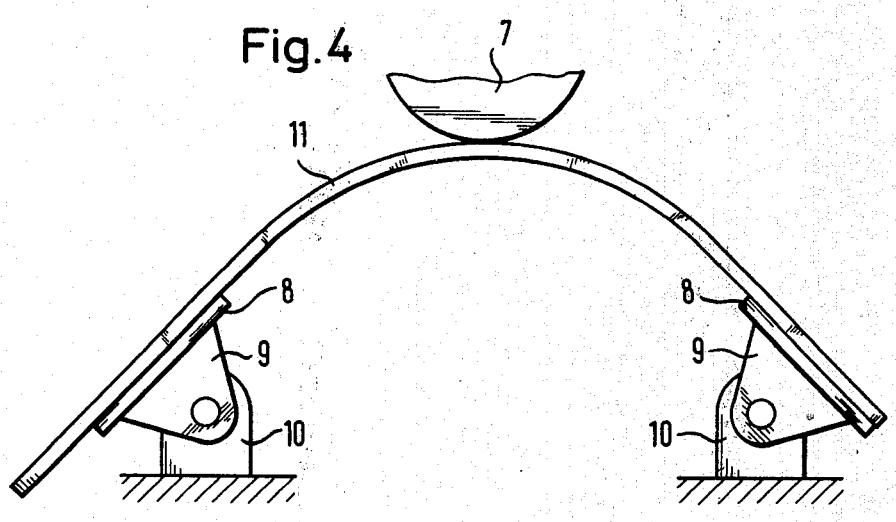
FIG. 4 illustrates a further form of application of the bending apparatus of the invention.

The case of a normal bending deformation of a sheet metal blank 11 is represented in FIG. 3, where the tip-supports 9 have occupied an inclined position. If, subsequently to the bending operation illustrated in FIG. 3, the blank is appropriately displaced and another bending stroke applied, it is possible to achieve correspondingly large radii of curvature.

Moreover, the new bending machine also permits a method of working wherein a previously bent sheet metal part 11 is restored to a more stretched or straightened condition, or flattened out. For this purpose the bent blank 11 is merely placed on the pads 8 which, owing to its curved conformation, automatically adjust oppositely to the normal direction of pivoting. When the press tool 7 is lowered, the tip-supports will then progressively return to their horizontal position.

We claim:

1. Bending apparatus for bending sheet and strip, comprising a bending punch movable through a punch plane, said bending punch having a working end elongated in said punch plane and curved in cross section, a pair of supports disposed respectfully at either side of said punch plane, said supports each having a planar support surface elongated in the direction of said bending punch working end and adapted to support a sheet or strip for engagement by said punch working end, said supports each being pivotable about first and second axes disposed in planes transverse to said punch plane and to each other, said bending punch being adjustable in said punch plane to dispose said working end parallel to and at oblique angles relative to said supported sheet or strip, whereby said supports are adapted to pivot to conform to the supported sheet or strip during bending, and to facilitate conical bending of said sheet or strip when said bending punch working end is disposed at an angle relative to said sheet or strip.

2. A bending apparatus for bending sheet and strip, comprising a bending punch movable through a punch plane, said bending punch having a working end elongated in said punch plane and curved in cross section, a pair of supports disposed respectively at either side of said punch plane, said supports each having a planar support surface elongated in the direction of said bending punch working end and adapted to support a sheet or strip for engagement by said punch working end, said supports each being pivotable about first axes extending in the direction of said bending punch working end and disposed in a plane transverse to said punch plane, said supports also being pivotable about second axes extending in the direction of said punch plane end and disposed in a plane transverse to said punch plane and said first mentioned pivotal axis plane, said bending punch being adjustable in said punch plane to dispose said working end parallel to and at oblique angles relative to said supported sheet or strip, whereby said supports are adapted to pivot about said first axes to conform to the supported sheet or strip during bending, and whereby said supports are pivotally adjustable about said second axes to facilitate conical bending of said sheet or strip when said bending punch working end is disposed at an oblique angle realtive to said supported sheet or strip.

* * * * *